United States Patent [19]

Reghi et al.

[11] 4,111,722

[45] Sep. 5, 1978

[54] TANNIN TREATMENT OF ALUMINUM WITH A FLUORIDE CLEANER

[75] Inventors: Gary A. Reghi, Sterling Heights; Samuel T. Farina, Mount Clemens, both of Mich.

[73] Assignee: Oxy Metal Industries Corporation, Warren, Mich.

[21] Appl. No.: 656,215

[22] Filed: Feb. 9, 1976

[51] Int. Cl.[2] ..... C23F 7/00; C23F 7/14

[52] U.S. Cl. ..... 148/6.15 R; 148/6.27

[58] Field of Search ..... 148/6.27, 6.14 R, 6.15 R; 106/14; 427/309; 156/22

[56] References Cited

U.S. PATENT DOCUMENTS

| | | | |
|---|---|---|---|
| 516,238 | 3/1894 | Strecker | 148/6.27 |
| 2,146,838 | 2/1939 | Newsome et al. | 148/6.27 |
| 2,146,840 | 2/1939 | Newsome et al. | 148/6.27 |
| 2,502,441 | 4/1950 | Dodd | 148/6.15 R |
| 2,851,385 | 9/1958 | Spruance, Jr. et al. | 148/6.27 |
| 2,854,368 | 9/1958 | Shreir | 148/6.15 R |
| 3,331,710 | 7/1967 | Lodeesen et al. | 148/6.27 |
| 3,448,055 | 6/1969 | Mickelson et al. | 156/22 |

FOREIGN PATENT DOCUMENTS

| | | | |
|---|---|---|---|
| 2,446,492 | 4/1975 | Fed. Rep. of Germany | 148/6.15 R |

*Primary Examiner*—Ralph S. Kendall

*Attorney, Agent, or Firm*—Arthur E. Kluegel; Richard P. Mueller

[57] ABSTRACT

Disclosed is a process for cleaning and treating an aluminum surface to improve the corrosion resistance and paint receptivity of the surface. The treating composition is an aqueous vegetable tannin composition, and the cleaning composition is an aqueous acidic fluoride containing cleaner.

14 Claims, No Drawings

TANNIN TREATMENT OF ALUMINUM WITH A FLUORIDE CLEANER

BACKGROUND OF THE INVENTION

This invention relates to the art of treating an aluminum surface to improve the properties thereof. More specifically, it relates to a process for treating an aluminum surface whereby the corrosion resistance and paint receptivity of the surface are improved.

Both alkaline and acidic aqueous solutions have been employed as cleaners for aluminum surfaces prior to further treatment. It has been proposed, for example in copending U.S. patent application Ser. No. 549,644, U.S. Pat. No. 3,969,135, that a cleaner for an aluminum surface may contain fluoride ion. It has also been proposed to employ an aqueous treating composition containing a vegetable tannin material in place of the conventional chromate phosphate aluminum treating bath. (See, for example, U.S. patent application Ser. No. 641,050 filed Dec. 15, 1975, Pat. No. 4,017,334, and a U.S. patent application in the name of King and Reghi filed concurrently herewith as a continuation-in-part of U.S. Ser. No. 612,075 filed Sept. 10, 1975, abandoned).

SUMMARY OF THE INVENTION

It has now been found that when a vegetable tannin-containing composition is employed as the primary treatment in place of the conventional chromate-phosphate treatment for an aluminum surface, the cleaner employed is very critical to obtaining acceptable improvements in corrosion resistance and paint receptivity. It has been found that a marked improvement in corrosion resistance is obtained by including fluoride ion in an aqueous acidic cleaning composition prior to treatment with a vegetable tannin-containing composition.

DETAILED DESCRIPTION OF THE INVENTION

The process of the present invention is one for treating an aluminum surface to improve the corrosion resistance and organic finish receptivity thereof by first contacting the surface with an aqueous acidic cleaning composition containing fluoride ion and thereafter treating the cleaned surface with an aqueous composition containing a vegetable tannin material.

The present invention permits the treatment of an aluminum surface to improve the corrosion resistance and organic finish receptivity without employing hexavalent chromium compounds as required by conventional processing techniques. Furthermore, the concentration of phosphate in the process compositions may be eliminated or reduced to very low levels compared to conventional techniques.

When conventional chromate-phosphate treating solutions are employed, the precise composition of the cleaner used in advance of the treatment has not been found to be particularly critical. In general, any cleaner which would accomplish the function of cleaning the surface in the desired amount of time is satisfactory. It has been found, however, that when a vegetable tannin-containing aqueous composition is employed in place of the conventional chromate-phosphate treatment, special care must be taken in the formulation of the cleaner as the cleaner composition will affect the ultimate quality of the treated surface.

Specifically, a marked improvement in the corrosion resistance imparted to an aluminum surface can be realized without a loss in organic finish receptivity by including fluoride ion in the aqueous cleaning composition prior to the tannin treatment step. The components of the cleaning composition other than fluoride may be any of those commonly employed in aqueous acidic cleaners for aluminum surfaces. Generally, these compositions will contain sulfuric acid as the major non-aqueous component together with one or more surfactants suitable for best removing the organic contaminants from the aluminum surface.

The precise minimum and maximum effective fluoride concentrations suitable for use in the cleaner cannot be stated without reference to parameters such as the particular cleaner and treating formulations employed; processing conditions such as contact time, method and temperatures of treatment; and the quality desired of the final product. In general, however, effective fluoride concentrations of from about 0.01 g/l to 0.5 g/l have been found effective with concentrations of from 0.01 to 0.2 g/l being preferred.

By the term "effective fluoride concentration" it is intended to include only fluoride present in the free form, uncomplexed with other multivalent elements such as boron, silicon, titanium, or aluminum. The "effective" or "free" fluoride ion concentration is the value commonly obtained when employing a specific ion electrode for fluoride detection manufactured by the Orion Co.

While fluoride ion is most conventionally supplied to the cleaner as an aqueous HF solution, any suitable source of fluoride which will provide the desired free fluoride ion concentration may be employed. Alkali metal or ammonium fluoride salts or double salts may be employed, for example.

Any conventional technique may be employed as a means of contacting the cleaner with the aluminum surface. Depending upon the specific formulation of the cleaner, temperatures of about 100° F. or higher are normally satisfactory. The temperature will normally also be a function of the contact time permitted as a result of the physical limitations of the treating facility. While contact times of 0.1 seconds and up may be used, typical contact times will vary from 10 seconds to 5 minutes with times of less than two minutes normally being sufficient.

The chemistry of tanning agents is not completely understood. They include a large group of water soluble, complex organic compounds widely distributed throughout the vegetable kingdom. All have the common property of precipitating gelatin from solutions and of combining with collagen and other protein matter in hides to form leather. All tannin extracts examined contain mixtures of polyphenolic substances and normally have associated with them certain sugars. (It is not known whether these sugars are an integral part of the structure.) For a discussion of tannins, see *Encyclopedia of Chemical Technology*, 2nd edition, Kirk-Othmer; XII (1967) pp. 303–341 and *The Chemistry and Technology of Leather*, Reinhold Publishing Corporation, New York, pp. 98–220 (1958).

Tannins are generally characterized as polyphenolic substances having molecular weights of from about 400 to about 3000. They may be classified as "hydrolyzable" or "condensed" depending upon whether the product of hydrolysis in boiling mineral acid is soluble or insoluble, respectively. Often extracts are mixed and contain both hydrolyzable and condensed forms. No two tannin extracts are exactly alike. Principal sources of tannin extracts include bark such as wattle, mangrove, oak, eucalyptus, hemlock, pine larch, and willow; woods such as quebracho, chestnut, oak and urunday, cutch and turkish; fruits such as myrobalans, valonia, divi-divi, tera, and algarrobilla; leaves such as sumac and gambier; and roots such as canaigre and palmetto.

The term "vegetable tannins" is employed to distinguish organic tannins such as those listed in the previous paragraph from the mineral tanning materials such as those containing chromium, zirconium and the like. Experimental work has shown that hydrolyzable, condensed, and mixed varieties of vegetable tannins may all be suitably used in the present invention. Quebracho and chestnut have been found to be very effective condensed tannins and myrobalan an effective hydrolyzable tannin.

Very small concentrations of the tannin extract have been found effective for improving the corrosion resistance and organic finish adhesion of an aluminum surface. The concentration to be used depends upon the particular tannin employed, the processing conditions selected and the quality and thickness of the resulting coating. If all conditions are properly adjusted, concentrations as low as 0.000025 weight percent are effective. Generally, the tannin concentration will be between this lower limit and 25 weight percent and, under the usual conditions, between about 0.002 and 0.25 weight percent. Most preferably, the concentration will be about 0.025 weight percent. Lower concentrations do not produce an appreciable improvement in characteristics, and higher concentrations result in an increased dragout of valuable chemicals on the workpieces. The pH of the aqueous solution must be adjusted to a value of at least 3 and is preferably less than about 9 and most preferably between 4 and 8. A pH somewhat on the acid side (as low as about 3) is typically obtained when a natural extract is dissolved in water. pH values below 3 do not produce the desired improvement in properties, and there is generally no reason to adjust to a pH above 9. Conventionally, the pH may be adjusted with any compatible acid or base typically used for that purpose such as, hydrochloric, sulfuric, phosphoric, hydrofluoric, nitric or acetic acids and the alkali metal hydroxides, carbonates or silicates. Only very small amounts are usually necessary for this purpose.

Aside from the mentioned pH adjuster, additional compatible components may optionally be included in the solution such as accelerators, surfactants and chelating agents. It is advantageous to include a small quantity of a soluble titanium compound, at least 0.003%, sufficient to further enhance the effect of the tannin. Examples of suitable titanium compounds include fluotitanic acid, titanium or titanyl sulfate and ammonium or alkali metal-halide double salts such as potassium titanium fluoride. The addition of a fluoride compound (simple or complex) is also advantageous. Fluoride acts to promote the reaction between the tannin and the aluminum surface and may also serve to solubilize titanium if desired. Where employed, concentrations of at least 0.006% F. are preferred. Where phosphate is employed, at least 0.001% is suitable.

Depending upon the qualities required of the final product, further embodiments have also been found advantageous. Inclusion of a lithium compound in the tannin composition tends to improve the corrosion resistance of the final product. Multiple tannin treatments generally yield better corrosion and/or adhesion results than does a single treatment.

The tannin treatment processing conditions of temperature, contact time and contact method are interdependent. Spray, immersion, and roll-on techniques may be employed. Contact times of as low as 0.1 seconds and temperatures of 90° to 150° F. are suitable. In the case of can manufacture, application of the chemicals is conventionally by the spray technique and, considering normal plant operations, the temperature of the solution will normally be from 90° to 150° F., preferably 90° to 125° F. (most preferably 100°–105° F.) and the contact time will normally be between 0.1 and 30 seconds and preferably between 5 and 30 seconds. Contact times of less than 5 seconds and usually less than one second are required in conduit processing of containers as described for example in U.S. Pat. No. 3,748,177 which is incorporated herein by reference. Of course, with suitable adjustment of the solution or processing conditions, values could be outside the above normal ranges.

The following tests were employed to evaluate the corrosion resistance and organic finish receptivity of the treated aluminum surface:

PASTEURIZATION

This test is a measure of the resistance to discoloration of a substrate which has been treated but to which no organic finish has been applied. The treated surface is immersed in tap water at 140°–160° F. (60°–70° C.) for 45 minutes. The surface is the observed for discoloration and rated "Acceptable" (colorless), "Marginal" (slight brown color) or "Unacceptable" (brown colored).

TAPE ADHESION

This test is a measure of the adhesion between an organic finish and a treated substrate. The painted surface is subjected to a standard 1% detergent solution (Joy; Proctor & Gamble) at boiling for 30 minutes, rinsed in tap water, cross-hatched (approximately 64 squares/sq. inch), and dried. Scotch-brand transparent tape (#610) is then applied to the cross-hatched area and the amount of paint removed by the tape is observed. Results are rated "Excellent" (100% adhesion), "Good" (95+% adhesion) or "Poor" (less than 95% adhesion).

EXAMPLE

An aqueous tannin treatment bath was prepared to contain:

| Component | g/l |
|---|---|
| Chestnut tannin extract | 0.15 |
| Titanyl sulfate | 0.14 as Ti |
| HF (70%) | 1.0 as F |
| $H_3PO_4$ | 0.1 as $PO_4$ |
| $NH_4OH$ | to pH 5.1 |
| Water | Balance |

Cleaner "A" was prepared to contain:

| Component | g/l |
|---|---|
| $H_2SO_4$ | 6.3 |
| $(NH_4)_2SO_4$ | 2.1 |
| Triton CF-10[1] | 1.9 |
| Surfactant AR-150[2] | 1.9 |

-continued

| Component | g/l |
|---|---|
| Fluoride as HF | 0 to 0.1 |

[1]Rohm & Haas Co. trademark for an alkylaryl polyether surfactant.
[2]Hercules, Inc. trademark for a polyethylene glycol ester of rosin.

Cleaner "B" was prepared to contain:

| Component | g/l |
|---|---|
| $H_2SO_4$ | 6.2 |
| Antarox LF 330[3] | 1.3 |
| Surfactant AR-150[2] | 1.3 |
| Flouride as HF | 0 to 0.5 |

[3]GAF Corp. trademark for aliphatic polyether surfactant.

The following process sequence was employed to spray-treat aluminum cans:

1. Clean — 30 sec.
2. Water rinse — 5 sec.
3. Tannin treatment, 105°–120° F., 20 sec.
4. Cold Water Rinse — 5 sec.
5. Deionized Water Rinse — 5 sec.
6. Oven Dry 350° F., 3 minutes.

Transparent ink (Acme Ink Co.) was then applied to the can exterior using rubber rolls. Next, clear overvarnish (Clement Coverall Co., Code # P-550-G, alkyd polyester) was applied over the wet ink using a # 5 draw down bar. The cans were then baked 5 min. at 350° F. A sanitary interior lacquer (Mobil S-6839-009, vinyl-based) was then applied to the interior followed by 3 min. at 410° F. to cure.

Both the interior and exterior surfaces were then tested for Tape Adhesion and the exterior can bottom was subjected to the Pasteurization test for discoloration of the unpainted surface. Both Cleaner A and Cleaner B were employed at temperatures of 120° F. and 180° F. with either no fluoride or with an effective fluoride concentration of 0.1 g/l. In every instance, the presence of fluoride improved the Pasteurization test results from "Unacceptable" to either "Marginal" or "Acceptable."

Twenty-one tests were run varying the effective fluoride concentration of Cleaner B at 120° F. from about 0.01 to 0.5 g/l. One test rated "Marginal" on Pasteurization while the other twenty were "Acceptable". When the fluoride-free cleaner was employed, "Unacceptable" Pasteurization was observed. As the fluoride concentration approached 0.4–0.5 g/l etching of the cans began to occur which is normally undesirable. Further, with the particular cleaner and tannin treatment employed, paint adhesions appeared consistantly "Poor" for fluoride concentrations above about 0.2 g/l. It should be understood that the maximum desirable fluoride concentration will be a function of parameters such as the particular cleaner and treating formulations employed, processing conditions such as contact time, method and temperatures of treatment, and the quality desired of the final product. Suitable fluoride levels may be selected by simple experimentation once these parameters have been determined.

What is claimed is:

1. A process for treating an aluminum surface to improve the corrosion resistance and organic finish receptivity thereof, comprising:
   (a) contacting the surface with an aqueous cleaning composition exhibiting a pH not in excess of 2.0 and consisting essentially of fluoride ion in an effective fluoride concentration of at least 0.1 g/l; and thereafter
   (b) contacting the cleaned surface with an aqueous composition exhibiting a pH of from 3 to 9 and consisting essentially of a vegetable tannin material in a concentration of at least 0.000025 wt. %.

2. The process of claim 1 wherein the effective fluoride concentration of the cleaner is 0.01 to 0.4 g/l.

3. The process of claim 1 wherein the cleaner is employed at a temperature not in excess of about 130° F.

4. The process of claim 3 wherein the cleaner is contacted with the surface for from 0.1 seconds to 5 minutes.

5. The process of claim 1 wherein the major non-aqueous component in the cleaner is sulfuric acid.

6. The process of claim 1 wherein the cleaner additionally contains at least one surface active compound selected from the group consisting of polyether and polyethylene glycol-rosin ester surfactant.

7. The process of claim 1 wherein the tannin composition additionally contains a soluble titanium compound and a simple or complex fluoride compound.

8. The process of claim 1 wherein the effective fluoride concentration is sufficient to improve the corrosion resistance or organic finish receptivity of the treated surface.

9. The process of claim 1 wherein the cleaning composition additionally contains sulfuric acid.

10. The process of claim 1 wherein the cleaning composition additionally contains at least one surfactant.

11. The process of claim 1 wherein the tannin composition additionally contains at least one pH adjuster.

12. The process of claim 1 wherein the tannin composition additionally contains a soluble titanium compound.

13. The process of claim 1 wherein the tannin composition additionally contains a simple or complex fluoride compound.

14. The process of claim 1 wherein the tannin composition additionally contains a phosphate compound.

* * * * *

UNITED STATES PATENT OFFICE

CERTIFICATE OF CORRECTION

Patent No. 4,111,722 Dated September 5, 1978

Inventor(s) Gary A. Reghi and Samuel T. Farina

It is certified that error appears in the above-identified patent and that said Letters Patent are hereby corrected as shown below:

Column 6, Claim 1, Line 7, please delete "0.1" and substitute therefor -- 0.01 --

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*